US008847821B2

(12) United States Patent
Murayama et al.

(10) Patent No.: US 8,847,821 B2
(45) Date of Patent: Sep. 30, 2014

(54) ANTENNA AND RADIO COMMUNICATION APPARATUS

(75) Inventors: Takuya Murayama, Ishikawa-ken (JP); Kengo Onaka, Kanagawa-ken (JP); Takashi Ishihara, Tokyo-to (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 642 days.

(21) Appl. No.: 12/960,958

(22) Filed: Dec. 6, 2010

(65) Prior Publication Data

US 2011/0095957 A1 Apr. 28, 2011

Related U.S. Application Data

(63) Continuation of application No. PCT/JP2009/055099, filed on Mar. 17, 2009.

(30) Foreign Application Priority Data

Jun. 6, 2008 (JP) ..... 2008-149650

(51) Int. Cl.

| | |
|---|---|
| ***H01Q 1/38*** | (2006.01) |
| ***H01Q 5/00*** | (2006.01) |
| ***H01Q 9/42*** | (2006.01) |
| ***H01Q 1/24*** | (2006.01) |

(52) U.S. Cl.

CPC ..... *H01Q 9/42* (2013.01); *H01Q 5/0055* (2013.01); *H01Q 1/38* (2013.01); *H01Q 1/243* (2013.01); *H01Q 5/0068* (2013.01)

USPC ..... 343/700 MS; 343/702; 343/749

(58) Field of Classification Search

CPC ..... H01Q 1/243; H01Q 9/42; H01Q 1/38; H01Q 5/0068; H01Q 5/0055

USPC ..... 343/700 MS, 702, 749

See application file for complete search history.

(56) References Cited

U.S. PATENT DOCUMENTS

| | | | | |
|---|---|---|---|---|
| 2005/0099347 | A1* | 5/2005 | Yamaki | 343/749 |
| 2008/0122714 | A1* | 5/2008 | Ishihara et al. | 343/750 |

FOREIGN PATENT DOCUMENTS

| | | | |
|---|---|---|---|
| JP | 2004-363859 | A | 12/2004 |
| JP | 2005-150937 | A | 6/2005 |

(Continued)

OTHER PUBLICATIONS

The Examination Report issued by United Kingdom Intellectual Property Office on Mar. 26, 2012; Patent Application No. GB1020656.3.

(Continued)

*Primary Examiner* — Douglas W Owens
*Assistant Examiner* — Jae Kim
(74) *Attorney, Agent, or Firm* — Studebaker & Brackett PC

(57) ABSTRACT

An antenna includes an antenna element in which feed and non-feed radiation electrodes are formed on a dielectric base; and a substrate having a non-ground area in which a ground electrode is not formed. The antenna element is provided in the non-ground area of the substrate. Each of the feed and non-feed radiation electrodes has a radiation electrode by which fundamental and harmonic waves resonate, a capacitance-loading terminal is formed at a position of the antenna element where an electric field distribution of the harmonic wave becomes a node, and a power supply terminal is formed at a feed end of the feed radiation electrode. A power supply terminal connection electrode connected to the power supply terminal and a capacitance-forming electrode for causing a capacitance to occur between the power supply terminal connection electrode and the capacitance-forming electrode portion are provided on the substrate.

6 Claims, 8 Drawing Sheets

(56) References Cited

FOREIGN PATENT DOCUMENTS

| | | | |
|---|---|---|---|
| JP | 2007-036338 | A | 2/2007 |
| JP | 2008-205572 | A | 9/2008 |
| WO | 2006/073034 | A1 | 7/2006 |
| WO | 2006/077714 | A1 | 7/2006 |

OTHER PUBLICATIONS

S.Kishida; "International Search Report"; PCT/JP2009/055099; Jun. 16, 2009.

S. Kshida; "Written Opinion of the International Searching Authority"; PCT/JP2009/055099; Jun. 16, 2009.

* cited by examiner

101

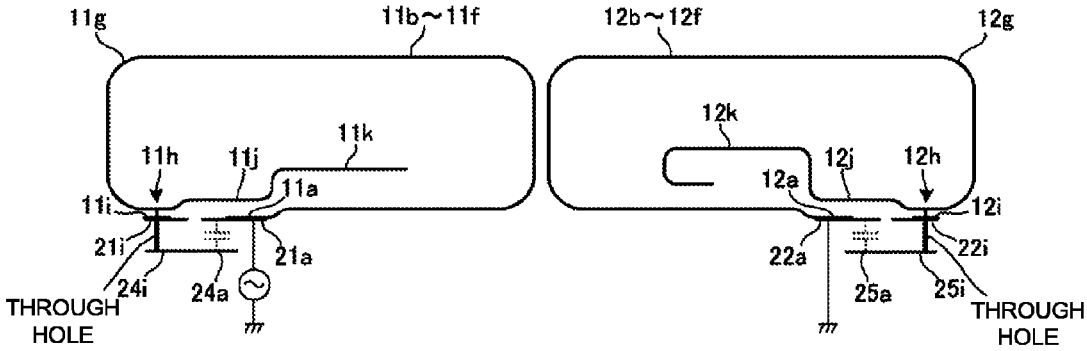
FIG.5
FIG.6A
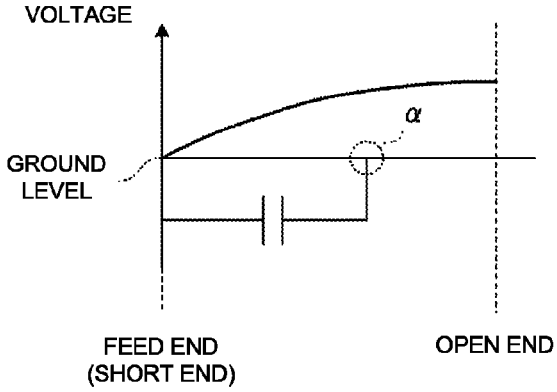
FIG.6B
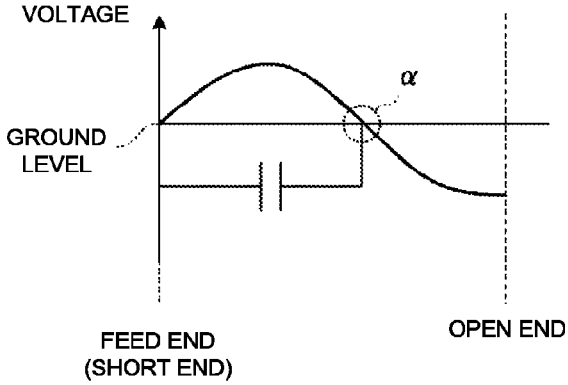

ANTENNA AND RADIO COMMUNICATION APPARATUS

CROSS REFERENCE TO RELATED APPLICATIONS

The present application is a continuation of International Application No. PCT/JP2009/055099 filed Mar. 17, 2009, which claims priority to Japanese Patent Application No. 2008-149650 filed Jun. 6, 2008, the entire contents of each of these applications being incorporated herein by reference in their entirety.

FIELD OF THE INVENTION

The present invention relates to an antenna for use in a radio communication apparatus such as a cellular phone terminal, and a radio communication apparatus having the antenna.

BACKGROUND

WO 2006/073034A1 (Patent Document 1) and WO 2006/077714A1 (Patent Document 2) each disclose an antenna that operates in a plurality of frequency bands.

Here, a configuration of the antenna disclosed in Patent Document 1 will be described with reference to FIG. 1. In the example of FIG. 1, a feed radiation electrode 7 is formed on a prism-shaped dielectric base 6. The feed radiation electrode 7 resonates in a fundamental mode and in a higher-order mode, and one end of the feed radiation electrode 7 defines a feed end 7A connected to a circuit for radio communication. The other end 7B of the feed radiation electrode defines an open end. The position of a capacitance-loading portion α is set in advance between the feed end 7A and the open end 7B of the feed radiation electrode 7, and a capacitance-loading conductor 12 is connected to the capacitance-loading portion α. The capacitance-loading conductor 12 forms a capacitance for adjusting a resonant frequency in the fundamental mode, between the feed end 7A and the capacitance-loading portion α.

Further, in the antenna disclosed in Patent Document 2, a feed radiation electrode and a non-feed radiation electrode, each having a spiral slit, are formed on a dielectric base. The dielectric base is provided in a non-ground area of a substrate, and a capacitance occurs at each of the spiral slits.

According to the antenna disclosed in Patent Document 1, the magnitude of the capacitance connected between the feed end 7A and the capacitance-loading portion α is set by the capacitance-loading conductor 12. Thus, the resonant frequency in the fundamental mode can be adjusted. In addition, by appropriately setting the position of the capacitance-loading portion α, the resonant frequency in the fundamental mode can be adjusted with a resonant frequency in a harmonic mode being maintained constant.

However, the shape of an electrode pattern on the prism-shaped dielectric base needs to be changed for adjusting or changing the loaded capacitance. The same is true for the antenna disclosed in Patent Document 2. For example, when the antenna is caused to operate as an antenna for two frequency bands, the 2 GHz band and the 900 MHz band, the resonant frequency in the fundamental mode is set at the 900 MHz band, and the resonant frequency in the harmonic mode is set at the 2 GHz band. When the resonant frequency in the harmonic mode is changed, and when the resonant frequency in the fundamental mode is changed by the loaded capacitance as well, the electrode pattern has to be changed. Thus, there is a problem that a period for development and designing is needed, resulting in an increase in cost.

SUMMARY

The invention is directed to an antenna that can allow for adjustment and setting of a frequency characteristic without changing the shape of an antenna element in which an electrode pattern is formed on a dielectric base; and a radio communication apparatus having the antenna.

An antenna consistent with the claimed invention includes an antenna element in which a helical or loop feed radiation electrode and a helical or loop non-feed radiation electrode are formed on a dielectric base. The antenna includes a substrate having, at one edge thereof, a non-ground area in which a ground electrode is not formed. The antenna element is provided in the non-ground area of the substrate.

Each of the feed radiation electrode and the non-feed radiation electrode has a radiation electrode by which a fundamental wave and a harmonic wave resonate.

A capacitance-loading terminal is formed at a position where an electric field distribution of the harmonic wave substantially becomes a node, and a power supply terminal is formed at a feed end of the feed radiation electrode.

A power supply terminal connection electrode connected to the power supply terminal, and the capacitance-loading terminal, are connected to the substrate, and a capacitance-forming electrode in which a branch portion is formed for causing a capacitance to occur between the power supply terminal connection electrode and the branch portion, is provided in the substrate.

According to a more specific embodiment consistent with the claimed invention, the capacitance-forming electrode may include a plurality of electrodes that have stepping-stone-shaped patterns and are connected to each other via a chip reactance element.

In another more specific embodiment consistent with the claimed invention, the plurality of electrodes having the stepping-stone-shaped patterns may have different lengths, and the chip reactance element is installed at a plurality of locations.

In another more specific embodiment consistent with the claimed invention, the capacitance-forming electrode portion and the power supply terminal connection electrode are provided on opposite sides of the substrate.

In yet another more specific embodiment consistent with the claimed invention, a radio communication apparatus may comprise an antenna having a configuration as described above, and is provided within a casing.

Other features, elements, characteristics and advantages of the present invention will become more apparent from the following detailed description of preferred embodiments of the present invention with reference to the attached drawings.

BRIEF DESCRIPTION OF DRAWINGS

FIG. 4A is a top view, and FIG. 4B is a bottom view.

FIG. 5 is an equivalent circuit diagram of the antenna shown in FIGS. 2 to 4B.

FIGS. 6A and 6B show a relation between a capacitance-loading position relative to a radiation electrode and an electric field distribution, where FIG. 6A shows an electric field distribution of a fundamental wave that is caused by a radiation electrode for a fundamental wave, and FIG. 6B shows an electric field distribution of a harmonic wave that is caused by a radiation electrode for a harmonic wave.

DETAILED DESCRIPTION

A configuration of an antenna according to a first exemplary embodiment and a configuration of a radio communication apparatus having the antenna will be described with reference to FIGS. 2 to 7B.

Figure 2:
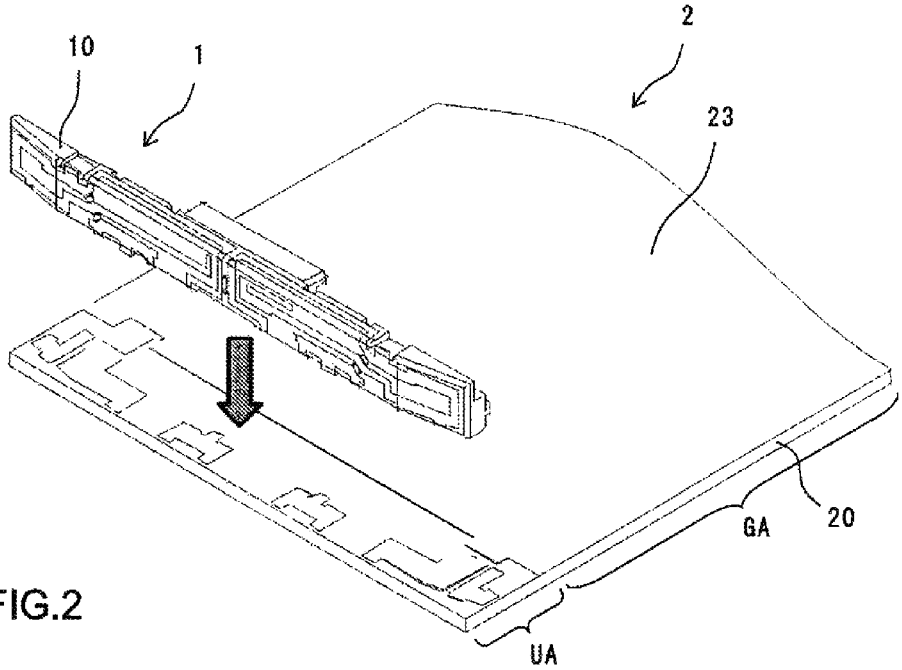
FIG. 2 is a partially exploded perspective view showing a configuration of an antenna, according to a first exemplary embodiment, which is incorporated in a radio communication apparatus such as a cellular phone terminal.

FIG. 2 is a partially exploded perspective view showing a configuration of an antenna 101 incorporated in a radio communication apparatus such as a cellular phone terminal. The antenna 101 includes: an antenna element 1 in which predetermined electrodes are formed on a dielectric base 10 having a shape corresponding to the shape of a casing of a radio communication apparatus; and a substrate 2 in which predetermined electrodes are formed on a base 20.

The substrate 2 has: a ground area GA in which a ground electrode 23 is formed on the base 20; and a non-ground area UA that extends along one side of the substrate 2 and in which the ground electrode 23 is not formed. The antenna element 1 is provided at a position within the non-ground area UA, which is distant from the ground area GA as much as possible, by surface mounting. When the antenna 101 is incorporated into a cellular phone terminal, the antenna 101 is provided in a bottom portion thereof.

Figure 1:
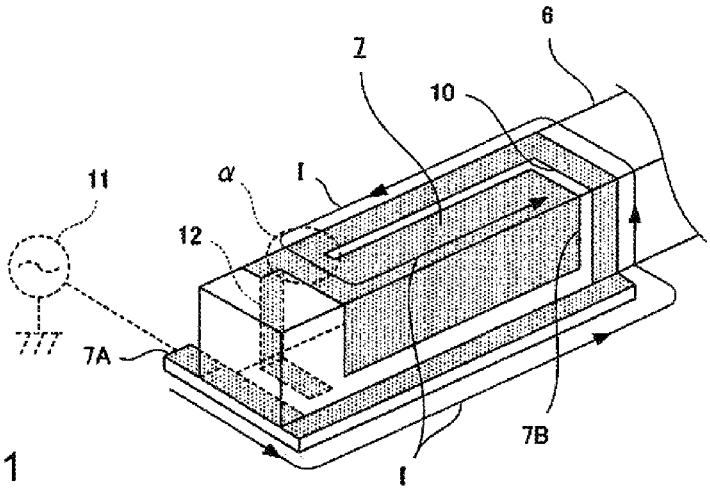
FIG.1 Prior Art
FIG. 1 is a view showing a configuration of an antenna disclosed in Patent Document 1.
Figure 3A:
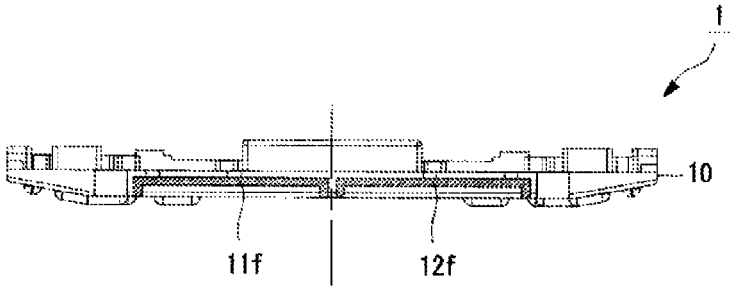
FIGS. 3A to 3F show a six-side view of the antenna element shown in FIG. 2.
Figure 3E:
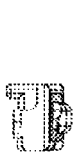
Figure 3B:
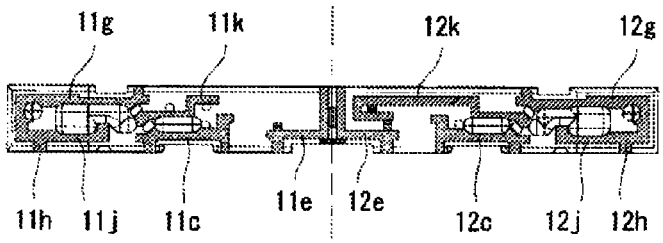
Figure 3F:
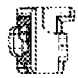
Figure 3C:
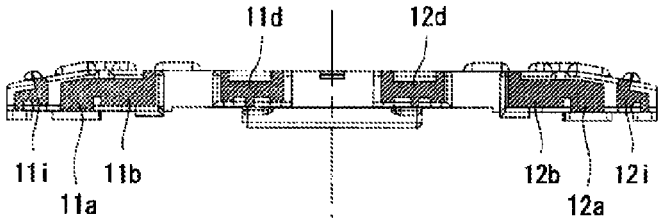
Figure 3D:
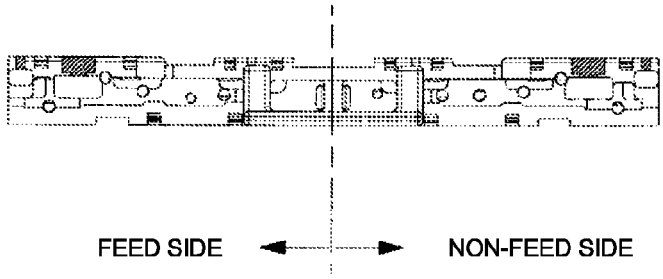

FIGS. 3A to 3F show an example of a six-side view of the antenna element 1 shown in FIG. 1. FIG. 3A is a top view; FIG. 3B is a front view; FIG. 3C is a bottom view; FIG. 3D is a back view; FIG. 3E is a left-side view; and FIG. 3F is a right-side view.

The dielectric base 10 and an electrode pattern formed thereon are bilaterally symmetrical about a line indicated by an alternate long and short dash line in the drawing. In this example, by using the single dielectric base 10, the antenna elements are configured such that the left side and the right side of the alternate long and short dash line are formed as an antenna element on a feed side and an antenna element on a non-feed side, respectively.

First, the feed side will be described. A capacitance-loading terminal 11*i*, a power supply terminal 11*a*, and electrodes 11*b* and 11*d* are formed on a bottom surface of the dielectric base 10. Electrodes 11*c*, 11*e*, 11*g*, 11*j*, and 11*k* are formed on a front surface of the dielectric base 10. In addition, a branch portion 11*h* is formed from the front surface to the bottom surface. An electrode 11*f* is formed on a top surface of the dielectric base 10.

The above terminals and electrodes are connected as follows: power supply terminal 11*a*→electrode 11*b*→electrode 11*c*→11*d*→11*e*→11*f*→11*g*→11*j*→11*k*. Further, the branch portion 11*h* is conducted to the capacitance-loading terminal 11*i* on the bottom surface. The electrode 11*k* is connected to the electrode 11*j*. In this way, a helical or loop feed radiation electrode is formed.

The non-feed side is now described. A capacitance-loading terminal 12*i*, a ground terminal 12*a*, and electrodes 12*b* and 12*d* are formed on the bottom surface of the dielectric base 10. Electrodes 12*c*, 12*e*, 12*g*, 12*j*, and 12*k* are formed on the front surface of the dielectric base 10. In addition, a branch portion 12*h* is formed from the front surface to the bottom surface. An electrode 12*f* is formed on the top surface of the dielectric base 10.

The above terminals and electrodes are connected as follows: ground terminal 12*a*→electrode 12*b*→electrode 12*c*→12*d*→12*e*→12*f*→12*g*→12*j*→12*k*. Further, the electrode 12*j* extends from the branch portion 12*h*. The branch portion 12*h* is conducted to the capacitance-loading terminal 12*i* on the bottom surface. The electrode 12*k* is connected to the electrode 12*j*. In this way, a helical or loop non-feed radiation electrode is formed.

Figure 4B:
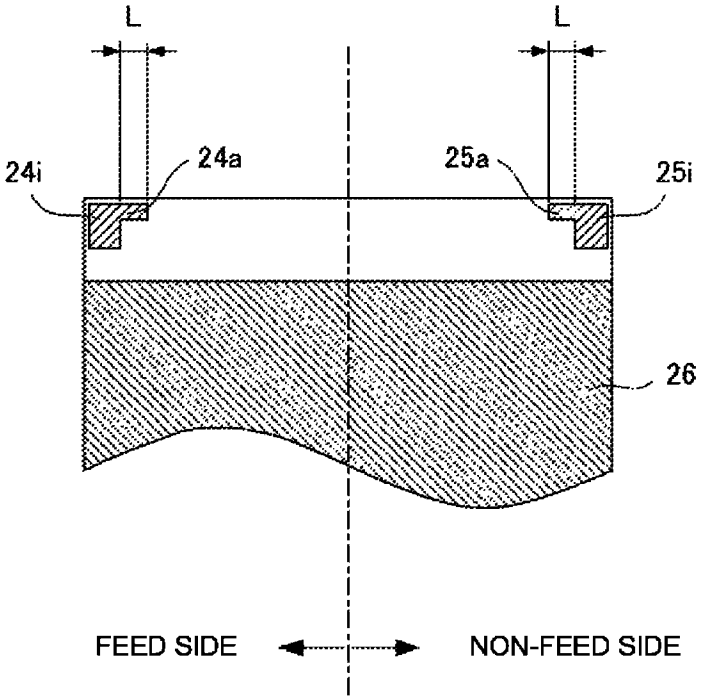
FIGS. 4A and 4B show patterns of various electrodes formed on a substrate 2 shown in FIG. 2, where
Figure 4A:
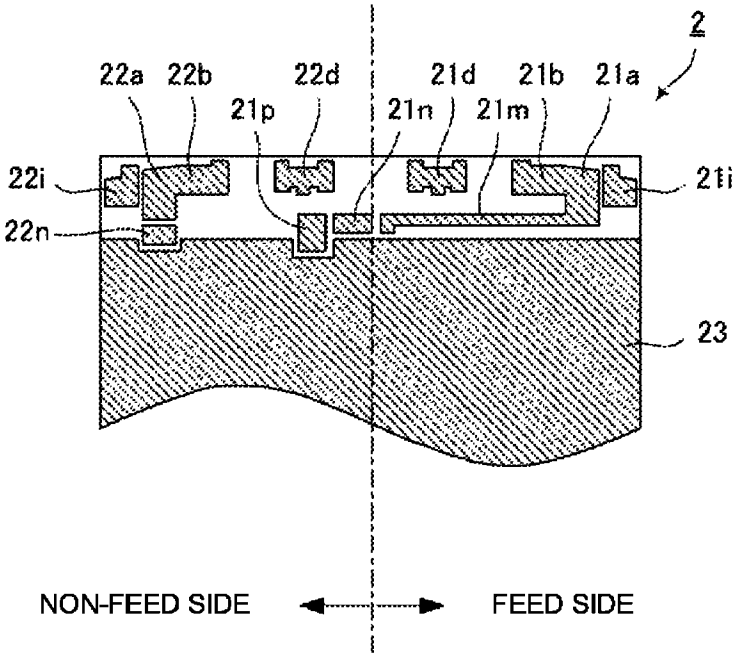

FIGS. 4A and 4*b* show exemplary patterns of various electrodes formed on the substrate 2 shown in FIG. 2, where FIG. 4A is a top view, and FIG. 4B is a bottom view.

An example of a feed side configuration is now described. With reference to FIG. 4A, a capacitance-loading terminal connection electrode 21*i*, a power supply terminal connection electrode 21*a*, and electrodes 21*b* and 21*d* are formed on the top surface of the non-ground area of the substrate 2. Further, an electrode 21*m* extending from the power supply terminal connection electrode 21*a*, and electrodes 21*n* and 21*p* each having a stepping-stone-shaped pattern from an end of the electrode 21*m*, are formed.

The capacitance-loading terminal 11*i* shown in FIG. 3C is connected to the capacitance-loading terminal connection electrode 21*i*. In addition, the power supply terminal 11*a* of the antenna element 1 is connected to the power supply terminal connection electrode 21*a*. Similarly, the electrodes 11*b* and 11*d* of the antenna element 1 are connected to the electrodes 21*b* and 21*d*, respectively, on the substrate.

A power supply circuit (transmitting/receiving circuit) is connected between the ground electrode 23 and the electrode 21*m* extending from the power supply terminal connection electrode 21*a*. In addition, a chip capacitor for a matching circuit, or a chip inductor, is installed between: the electrodes 21*n* and 21*p* having the stepping-stone-shaped patterns; and the ground electrode 23, and between: the electrodes 21*n* and 21*p*; and the electrode 21*m*.

An example of a non-feed side configuration is now described with reference to FIG. 4A. A capacitance-loading terminal connection electrode 22*i*, a ground terminal connection electrode 22*a*, and electrodes 22*b* and 22*d* are formed on the top surface of the non-ground area of the substrate 2. In addition, an electrode 22*n* having a stepping-stone-shaped pattern is formed between the ground terminal connection electrode 22*a* and the ground electrode 23.

The capacitance-loading terminal 12*i* shown in FIG. 3C is connected to the capacitance-loading terminal connection electrode 22*i*. In addition, the ground terminal 12*a* of the antenna element 1 is connected to the ground terminal connection electrode 22*a*. Similarly, the electrodes 12*b* and 12*d* of the antenna element 1 are connected to the electrodes 22*b* and 22*d*, respectively, on the substrate.

A chip capacitor for a matching circuit, or a chip inductor, can be installed between the ground terminal connection electrode 22*a* and the electrode 22*n* having the stepping-stone-shaped pattern, and between the electrode 22*n* and the ground electrode 23.

On the feed side of the bottom surface of the substrate 2, as shown in FIG. 4B, an electrode 24*i* is formed at a position opposed to the capacitance-loading terminal connection electrode 21*i* on the top surface, and an electrode 24*a* is formed at a position opposed to the power supply terminal connection electrode 21*a* on the top surface. The capacitance-loading terminal connection electrode 21*i* and the electrode 24*i* opposed thereto are conducted, or connected to each other via a through hole (not shown). Because the electrodes 24*i* and 24*a* are connected to each other, a capacitance occurs at a portion where the electrode 24*a* is opposed to the power supply terminal connection electrode 21*a* across the base (i.e., base 20 shown in FIG. 2) of the substrate 2.

On the non-feed side of the bottom surface of the substrate 2, as shown in FIG. 4B, an electrode 25*i* is formed at a position opposed to the capacitance-loading terminal connection electrode 22*i* on the top surface, and an electrode 25*a* is formed at a position opposed to the ground terminal connection electrode 22*a* on the top surface. The capacitance-loading terminal connection electrode 22*i* and the electrode 25*i* opposed thereto are conducted, or connected to each other via a through hole (not shown). Because the electrode 25*i* and 25*a* are connected to each other, a capacitance occurs at a portion where the electrode 25*a* is opposed to the ground terminal connection electrode 22*a* across the base (i.e., base 20 shown in FIG. 2) of the substrate 2.

FIG. 5 is an equivalent circuit diagram of the antenna 101 shown in FIGS. 2 to 4B. First, the feed side of the equivalent circuit will be described with reference to the left-hand side of FIG. 5. A loop from the power supply terminal 11*a* via the electrodes 11*b* to 11*g* and 11*j* to the electrode 11*k* forms: a radiation electrode for a fundamental wave, which resonates at a substantially ¼ wavelength; and a radiation electrode for a harmonic wave, which resonates at a substantially ¾ wavelength.

The capacitance-loading terminal 11*i* is conducted to the capacitance-loading terminal connection electrode 21*i* on the top surface of the substrate 2, and the capacitance-loading terminal connection electrode 21*i* is conducted, or connected to the electrode 24*i* on the bottom surface of the substrate 2 via the through hole. Between the capacitance-forming electrode 24*a*, extending from the electrode 24*i*, and the power supply terminal connection electrode 21*a* on the substrate top surface, the capacitance occurs as represented by a symbol, for a capacitor, of a dashed line in the drawing.

Similarly, on the non-feed side depicted at the right hand-side of FIG. 5, a loop from the ground terminal 12*a* via the electrodes 12*b* to 12*g* and 12*j* to the electrode 12*k* forms: a radiation electrode for a fundamental wave, which resonates at a ¼ wavelength; and a radiation electrode for a harmonic wave, which resonates at a ¾ wavelength.

The capacitance-loading terminal 12*i* is conducted to the capacitance-loading terminal connection electrode 22*i* on the top surface of the substrate 2, and the capacitance-loading terminal connection electrode 22*i* is conducted to the electrode 25*i* on the bottom surface of the substrate 2 via the through hole. Between the capacitance-forming electrode 25*a*, extending from the electrode 25*i*, and the power supply terminal connection electrode 21*a* on the substrate top surface, the capacitance occurs as represented by a symbol, for a capacitor, of a dashed line in the drawing.

As shown in FIG. 5, power is supplied from the power supply terminal 11*a* directly to the radiation electrode for a fundamental wave and the radiation electrode for a harmonic wave which are formed from the electrodes (power supply terminals) 11*a* to 11*k*.

FIG. 6A shows an electric field distribution of a fundamental wave that is caused by the radiation electrode for a fundamental wave, and FIG. 6B shows an electric field distribution of a harmonic wave that is caused by the radiation electrode for a harmonic wave. As is obvious from FIG. 5, the radiation electrode for a fundamental wave resonates at the ¼ wavelength, and a capacitance is loaded between the branch portion 11*h* and a feed end of the radiation electrode for a fundamental wave. Thus, a resonant frequency in a fundamental mode changes due to the loaded capacitance.

On the other hand, in the radiation electrode for a harmonic wave, which resonates at the ¾ wavelength, the branch portion 11*h* is set such that the branch portion 11*h* or a position adjacent to the branch portion 11*h* corresponds to a node of the harmonic electric field distribution. Thus, the resonant frequency of the harmonic wave is almost not affected by the loaded capacitance. In this way, the resonant frequency in the fundamental mode can be adjusted independently of a resonant frequency in a harmonic mode.

Figure 7A:
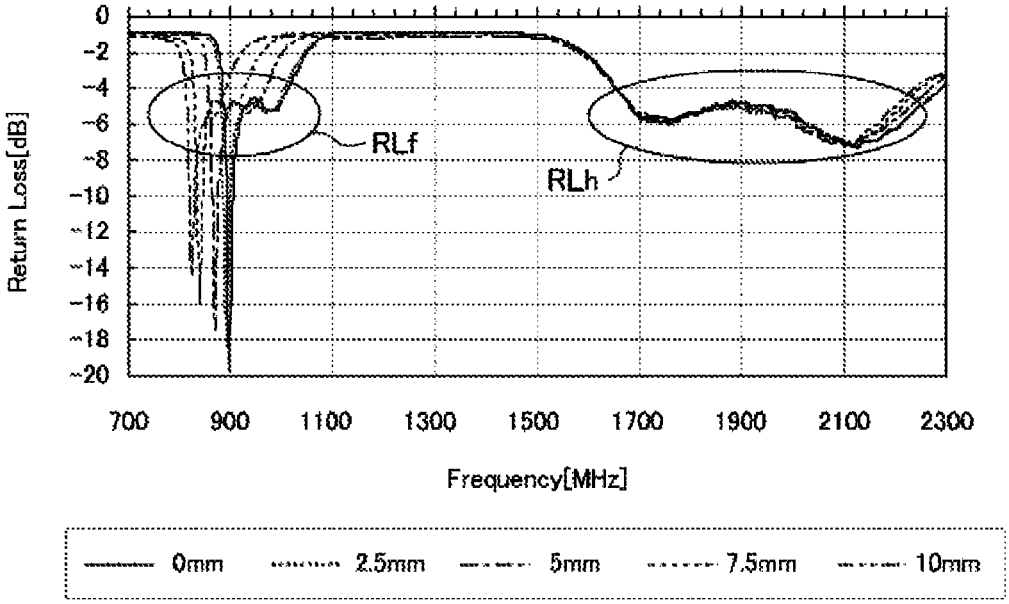
FIGS. 7A and 7B are graphs showing characteristics of return loss of the antenna obtained when the lengths L of capacitance-forming electrodes shown in FIG. 4B are changed.
Figure 7B:
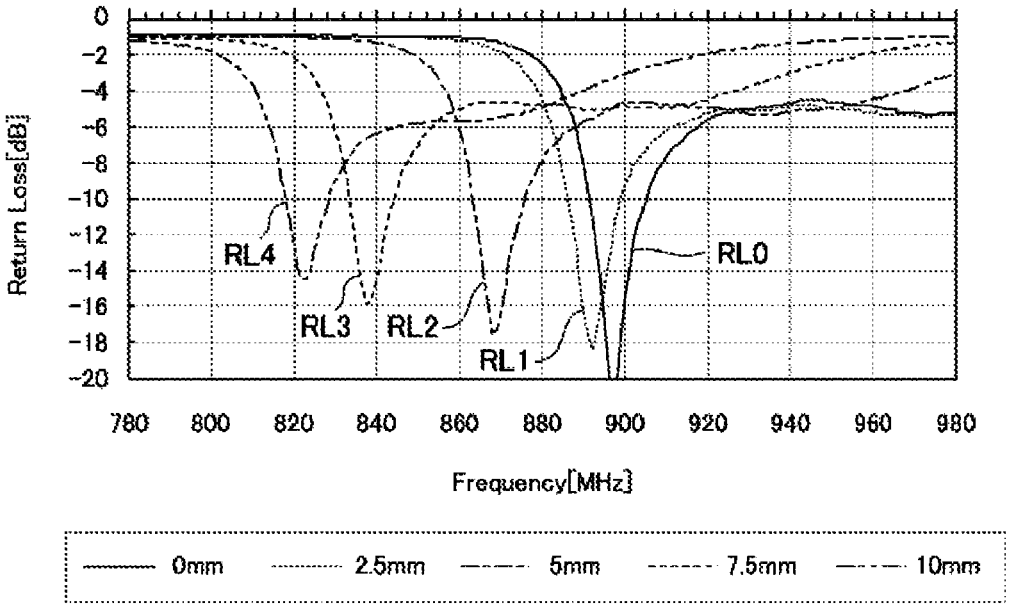

FIGS. 7A and 7B are graphs in which characteristics of return loss of the antenna are obtained when the lengths L of capacitance-forming electrodes 24*a* and 25*a* shown in FIG. 4B are changed. In FIG. 7A, the return loss appearing on the low-frequency side and indicated by RLf is caused by resonance in the fundamental mode, and the return loss appearing on the high-frequency side and indicated by RLh is caused by resonance in the harmonic mode. As the lengths L of the capacitance-forming electrodes 24*a* and 25*a* are changed, the characteristic of the return loss RLf on the low-frequency side changes but the characteristic of the return loss RLh on the high-frequency side almost does not change.

FIG. 7B shows a change of the return loss RLf caused by the fundamental mode, which is shown in FIG. 7A. When the projecting lengths L of the capacitance-forming electrodes 24*a* and 25*a* shown in FIG. 4B are set at 0, the return loss exhibits a characteristic indicated by RLO. When the lengths L of the capacitance-forming electrodes 24*a* and 25*a* are set at 2.5 mm, 5.0 mm, 7.5 mm, and 10.0 mm, the return loss changes as indicated by RL1, RL2, RL3, and RL4. In other words, the larger the lengths L of the capacitance-forming electrodes 24*a* and 25*a* are, the lower the resonant frequency of the fundamental wave is. Thus, by setting the lengths L of the capacitance-forming electrodes 24*a* and 25*a*, the frequency on the low-frequency side can be set without changing the antenna element 1.

Figure 8:
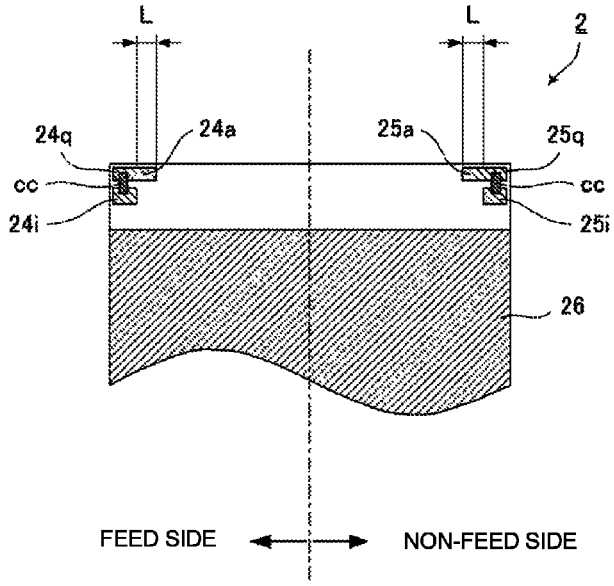
FIG. 8 is a bottom view of a substrate of an antenna according to a second exemplary embodiment.

FIG. 8 is a bottom view of a substrate 2 of an antenna according to a second exemplary embodiment. A configuration in the second exemplary embodiment differs from the configuration in the first exemplary embodiment shown in FIG. 4B, in that each capacitance-forming electrode is formed as a plurality of electrodes having stepping-stone-shaped patterns. In the example shown in FIG. 8, the capacitance-forming electrode 24*i* in FIG. 4B is divided into: a capacitance-forming electrode 24*q* connected to the capacitance-forming electrode 24*a*; and a capacitance-forming electrode 24*i*, and a chip capacitor CC is installed between the capacitance-forming electrode 24*q* and the capacitance-forming electrode 24*i*.

Similarly, on the non-feed side, the capacitance-forming electrode 25*i* in FIG. 4B is divided into: a capacitance-forming electrode 25*q* connected to the capacitance-forming electrode 25*a*; and a capacitance-forming electrode 25*i*, and a chip capacitor CC is installed between the capacitance-forming electrode 25*q* and the capacitance-forming electrode 25*i*.

Figure 9:
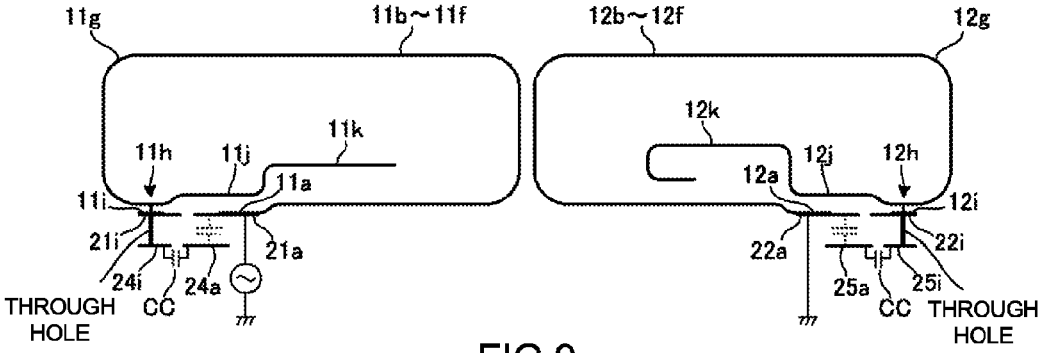
FIG. 9 is an equivalent circuit diagram of the antenna according to the second exemplary embodiment, in which the substrate shown in FIG. 8 is used.

FIG. 9 is an equivalent circuit diagram of the antenna according to the second exemplary embodiment, in which the substrate 2 shown in FIG. 8 is used. An antenna element mounted on the substrate is the same as that shown in the first exemplary embodiment. As shown on the left-hand side of FIGS. 8 and 9, on the feed side, the chip capacitor CC is connected between the capacitance-forming electrodes 24*i* and 24*q*, and a capacitance occurs between the capacitance-forming electrode 24*a* and the power supply terminal connection electrode 21*a* due to the substrate. Thus, a series circuit having the capacitance due to the substrate and the capacitance of the chip capacitor CC is connected between the power supply terminal 11*a* and the branch portion 11*h*, and a combined loaded capacitance is set by the capacitance of the chip capacitor CC.

Similarly, on the non-feed side shown at the right-hand side of FIGS. 8 and 9, the chip capacitor CC is connected between the capacitance-forming electrodes 25*i* and 25*q*, and a capacitance occurs between the capacitance-forming electrode 25*a* and the ground terminal connection electrode 22*a* due to the substrate. Thus, a series circuit having the capacitance due to the substrate and the capacitance of the chip capacitor CC is connected between the ground terminal 12*a* and the branch portion 12*h*, and a combined loaded capacitance is set by the capacitance of the chip capacitor CC.

In this way, the loaded capacitance between the feed end and the branch portion or between the grounding point and the branch portion can be set by installing the chip capacitor having a predetermined capacitance. Thus, the resonant frequency in the fundamental mode can be set and adjusted without changing the electrode patterns of the electrodes on the substrate 2 side as well.

FIGS. 10A to 10D show characteristics of return loss of the antenna that are obtained when the capacitances of the chip capacitors CC are changed.

Figure 10A:
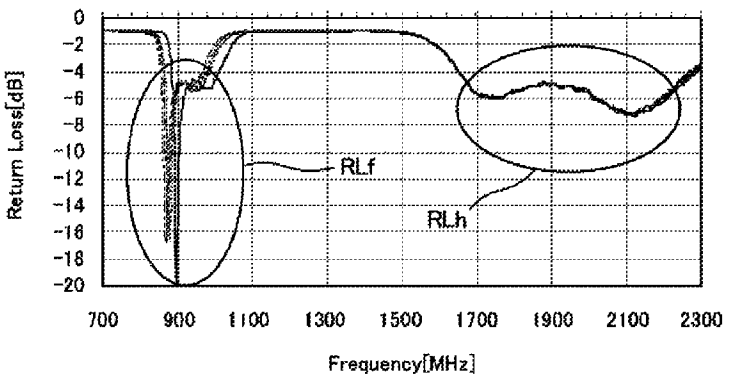
FIGS. 10A to 10D show characteristics of return loss of the antenna that are obtained when the capacitances of chip capacitors shown in FIG. 8 are changed.
Figure 10B:
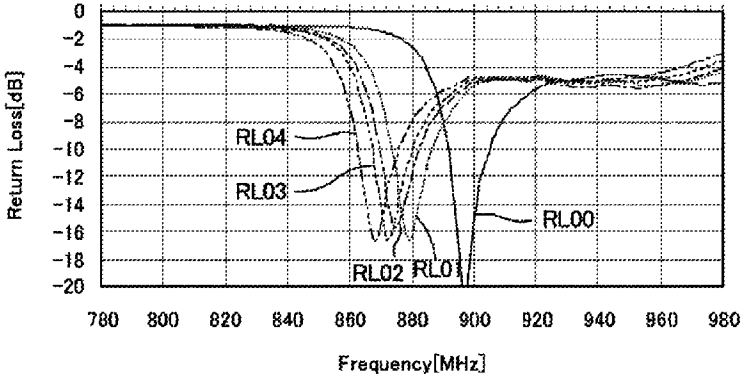
Figure 10C:
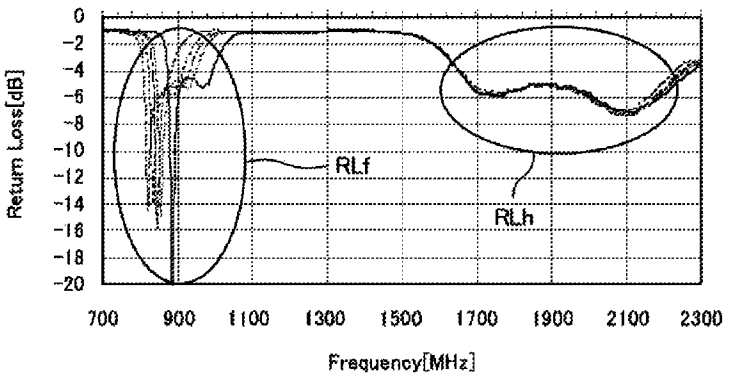
Figure 10D:
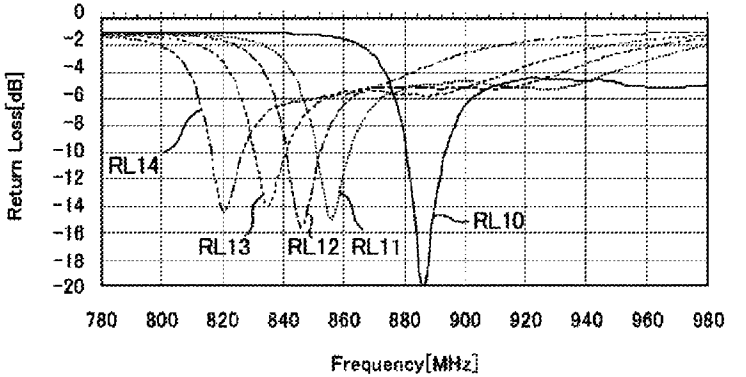

FIGS. 10A and 10B show characteristics obtained when the lengths L of the capacitance-forming electrodes 24*a* and 25*a* shown in FIG. 8 are set at 5.0 mm, and FIGS. 10C and 10D show characteristics obtained when the lengths L are set at 10.0 mm. In FIGS. 10A and 10C, the return loss appearing on the low-frequency side and indicated by RLf is caused by a fundamental wave, and the return loss appearing on the high-frequency side and indicated by RLh is caused by a harmonic wave.

FIG. 10B shows a change of the return loss RLf caused by the fundamental mode, which is shown in FIG. 10A. When the chip capacitors CC shown in FIG. 8B are not installed, the return loss exhibits a characteristic indicated by RL00 in the drawing. When the capacitances of the chip capacitors CC are set at 0.5 pF, 1 pF, and 2 pF, the return loss changes as indicated by RL01, RL02, and RL03. In addition, when the chip capacitors are set at 0Ω, in other words, when the capacitance-forming electrodes are not divided, the return loss exhibits a characteristic indicated by RL04. As described above, the larger the capacitances of the chip capacitors CC are, the lower the resonant frequency of the fundamental wave is.

Further, FIG. 10D shows a change of the return loss RLf caused by the fundamental mode, which is shown in FIG. 10C. When the chip capacitors CC shown in FIG. 8B are not installed, the return loss exhibits a characteristic indicated by RL10 in the drawing. When the capacitances of the chip capacitors CC are set at 0.5 pF, 1 pF, and 2 pF, the return loss changes as indicated by RL11, RL12, and RL13. In addition, when the chip capacitors are set at 0Ω, in other words, when the capacitance-forming electrodes are not divided, the return loss exhibits a characteristic indicated by RL14. As described above, the larger the capacitances of the chip capacitors CC are, the lower the resonant frequency of the fundamental wave is.

In this way, by using the capacitances of the installed chip capacitors, the frequency on the low-frequency side can be set without changing the antenna element 1 and also without changing the patterns on the substrate.

Figure 11:
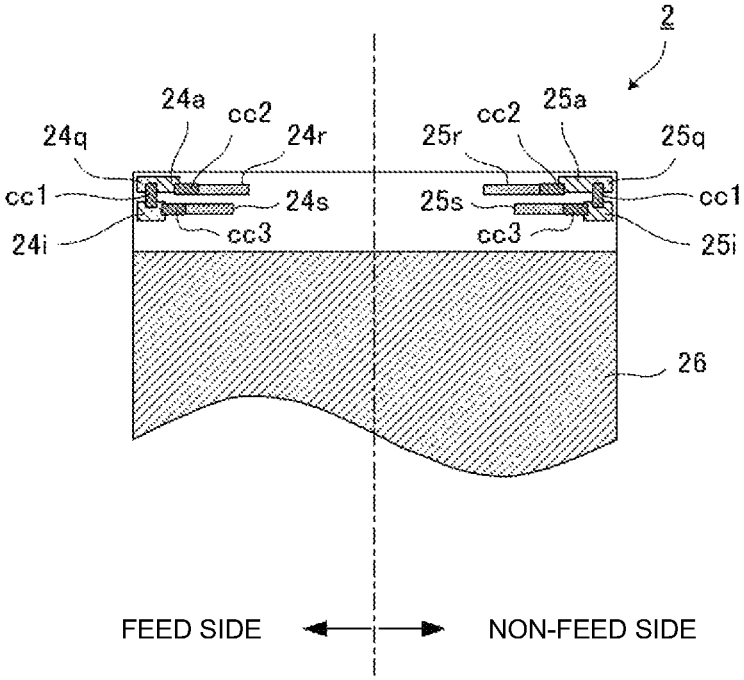
FIG. 11 is a bottom view of a substrate used in an antenna according to a third exemplary embodiment.

FIG. 11 is a bottom view of a substrate used in an antenna according to a third exemplary embodiment. In this example, as capacitance-forming electrodes, capacitance-forming electrodes 24*r* and 24*s* each having a stepping-stone shape are formed on the feed side, and capacitance-forming electrodes 25*r* and 25*s* each having a stepping-stone shape are formed on the non-feed side. The capacitance-forming electrodes 24*r* and 24*s* are opposed to the electrode extending from the power supply terminal connection electrode on the top surface of the substrate 2, and the capacitance-forming electrodes 25*r* and 25*s* are opposed to the electrode extending from the ground terminal connection electrode on the top surface of the substrate 2. The electrode pattern on the top surface of the substrate 2 is same as that in the first embodiment shown in FIG. 4A.

On the feed side, a chip capacitor CC2 is installed between the capacitance-forming electrodes 24*q* and 24*r*, and a chip capacitor CC3 is installed between the capacitance-forming electrodes 24*i* and 24*s*. By using the capacitances of these chip capacitors CC1 to CC3, the loaded capacitance between the branch portion (11*h*) and the power supply terminal (11*a*) of the antenna element can be set with high accuracy.

Similarly, on the non-feed side, a chip capacitor CC2 is installed between the capacitance-forming electrodes 25*q* and 25*r*, and a chip capacitor CC3 is installed between the capacitance-forming electrodes 25*i* and 25*s*. By using the capacitances of these chip capacitors CC1 to CC3, the loaded capacitance between the branch portion (12*h*) and the ground terminal (12*a*) of the antenna element can be set with high accuracy.

The second and third exemplary embodiments each have described the case where the chip capacitors are used as chip reactance elements, but chip inductors may be used. In this case, the fundamental mode in the resonant frequency changes in accordance with the inductances of the chip inductors.

Embodiments consistent with the invention make it is possible to adjust the resonant frequency in the fundamental mode only by changing the electrode pattern on the substrate side, with the electrode pattern formed in the antenna element, being maintained unchanged.

In addition, the resonant frequency in the fundamental mode can be independently controlled with the resonant frequency in the harmonic mode maintained constant.

Further, because it is unnecessary to change the antenna element, the lead time can be shortened and cost reduction can be achieved.

While preferred embodiments of the invention have been described above, it is to be understood that variations and modifications will be apparent to those skilled in the art without departing from the scope and spirit of the invention. The scope of the invention, therefore, is to be determined solely by the following claims and their equivalents.

What is claimed is:

1. An antenna comprising:

an antenna element in which a helical or loop feed radiation electrode and a helical or loop non-feed radiation electrode are formed on a dielectric base; and a substrate including first and second surfaces opposed to each other, a ground electrode being provided on the first surface of the substrate, the substrate having a non-ground area which is provided at one edge of the first surface of the substrate and in which a ground electrode is not formed, the antenna element being provided in the non-ground area of the substrate, wherein each of the feed radiation electrode and the non-feed radiation electrode has a radiation electrode by which a fundamental wave and a harmonic wave resonate, a capacitance-loading terminal is formed at a position of the antenna element where an electric field distribution of the harmonic wave substantially becomes a node, and a power supply terminal is formed at a feed end of the feed radiation electrode, a power supply terminal connection electrode is provided on the first surface of the substrate and connected to the substrate and to the power supply terminal, and the capacitance-loading terminal is connected to the substrate, and a capacitance-forming electrode having a portion provided on the second surface of the substrate for causing a capacitance to occur between the power supply terminal connection electrode and the capacitance-forming electrode portion is provided on the substrate, wherein the capacitance-forming electrode portion and the power supply terminal connection electrode are provided on opposite sides of the substrate.

2. The antenna according to claim 1, wherein the capacitance-forming electrode portion includes a plurality of electrodes separated from each other and are connected to each other via a chip reactance element.

3. The antenna according to claim 2, wherein the plurality of electrodes separated from each other have different lengths, and the chip reactance element is installed at a plurality of locations.

4. A radio communication apparatus comprising the antenna according to claim 1 provided within a casing.

5. A radio communication apparatus comprising the antenna according to claim 2 provided within a casing.

6. A radio communication apparatus comprising the antenna according to claim 3 provided within a casing.

* * * * *